US007100386B2

(12) United States Patent
Lifson

(10) Patent No.: US 7,100,386 B2
(45) Date of Patent: Sep. 5, 2006

(54) ECONOMIZER/BY-PASS PORT INSERTS TO CONTROL PORT SIZE

(75) Inventor: Alexander Lifson, Manlius, NY (US)

(73) Assignee: Scroll Technologies, Arkadelphia, AR (US)

( * ) Notice: Subject to any disclaimer, the term of this patent is extended or adjusted under 35 U.S.C. 154(b) by 277 days.

(21) Appl. No.: 10/390,051

(22) Filed: Mar. 17, 2003

(65) Prior Publication Data

US 2004/0184932 A1 Sep. 23, 2004

(51) Int. Cl.
*F25B 41/00* (2006.01)
*F25B 49/00* (2006.01)
*F01C 13/00* (2006.01)

(52) U.S. Cl. ..... 62/196.1; 62/228.5; 418/39; 418/55.2

(58) Field of Classification Search ..... 62/196.1, 62/228.5; 417/310; 418/39, 55.2; 29/888.022
See application file for complete search history.

(56) References Cited

U.S. PATENT DOCUMENTS 5,474,431 A 12/1995 Fairbanks
5,582,511 A 12/1996 Fairbanks
5,996,364 A * 12/1999 Lifson et al. ..... 62/196.1
6,142,753 A 11/2000 Bush
6,293,767 B1 * 9/2001 Bass ..... 417/310

* cited by examiner

*Primary Examiner*—Chen Wen Jiang
(74) *Attorney, Agent, or Firm*—Carlson, Gaskey & Olds

(57) ABSTRACT

Compressor performance is affected by the size of an economizer or by-pass port area. To achieve variation in size, an insert is inserted into an economizer and/or unloader flow passage to provide a desired port area. The insert may be selected from a number of available insert sizes having different sized openings. In this way, a compressor designer can minimize machining time by keeping same flow passage geometry for different compressor sizes and applications.

10 Claims, 5 Drawing Sheets

ECONOMIZER/BY-PASS PORT INSERTS TO CONTROL PORT SIZE

BACKGROUND OF THE INVENTION

This application relates to the use of inserts having a variable opening formed within the insert to allow selection of the port size for an economizer or by-pass path in a compressor.

One type of sealed compressor that is becoming widely utilized in refrigerant compression applications is a scroll compressor. Scroll compressors present several design challenges. One particular design challenge is achieving a reduced cooling capacity level when full capacity operation of the compressor is not desired. In many situations, it may not be desirable to have full capacity of the compressor.

Thus, to achieve reduced capacity, scroll compressors have been provided with additional internal passages and an unloader by-pass valve which diverts a portion of the compressor refrigerant back to a compressor suction port. In this way, the mass of refrigerant being compressed is reduced. The size of the passages which communicate with the by-pass valve effects the amount of by-pass fluid and thus the amount by which the capacity is reduced.

On the other hand, in for other applications, there is a need to achieve increased capacity or to improve refrigerant cycle efficiency. One way of achieving increased capacity and improving efficiency is the inclusion of an economizer circuit in the refrigerant system. An economizer circuit essentially provides heat transfer between a main refrigerant flow downstream of the condenser, and a second refrigerant flow which is also tapped downstream of the condenser and an upstream of a main expansion valve. The main flow is cooled in a heat exchanger by the second flow. In this way, the main flow from the condenser is cooled before passing through its own expansion valve and entering the evaporator. Since the main flow enters the main expansion valve at a cooler temperature, it has greater capacity to absorb heat in the evaporator which results in increased system cooling capacity and improved cycle efficiency. The refrigerant from the second flow path enters the compression chambers of the compressor at an intermediate compression point downstream of suction. Typically, the second flow path economizer fluid is injected at a point after the compression chambers have been closed.

The use of economizer circuits has become more widespread in recent years.

It is also known in the prior art how the unloader and economizer function can be combined together. Such a system is shown in prior U.S. Pat. No. 5,996,364.

The economizer and unloader circuits are utilized to obtain optimum cooling capacity and improve cycle efficiency. Further control of capacity and efficiency improvement is achieved by varying the size of economizer and unloader passages. The optimum size of these passages is dependent upon compressor size, and the particular application. Thus, it would be desirable to have an easy way to vary the size of the economizer and unloader passages. To date, achieving variation in the size of the passages has required that the ports be machined into the elements of the compressor to a desired size. This results in machining difficulties, increased cycle time, the requirement of increased inventory, and challenges with regard to machining the exact optimum size economizer or unloader passages.

While it has been proposed to utilize inserts in scroll compressors to control the size of a discharge port, no such use has ever been proposed for economizer or unloader ports or passages.

SUMMARY OF THE INVENTION

In the disclosed embodiment of this invention, inserts are provided having internal openings of varying dimensions. The inserts are selected to provide a restriction in an economizer and/or unloader passage to achieve the desired port area for the particular compressor application or compressor size. It is within the skill of a worker in this art to recognize that different port areas may be desired for different size compressors, or different applications. As an example, a refrigeration system may have a larger economizer port size than the same compressor utilized for a standard air conditioning application or a compressor with larger displacement may also have large economizer port size. The present invention allows the selection of a particular insert for use in the passage which provides the desired port size without changes in machining of the passages from one compressor to another.

Since the passages are somewhat torturous and extend in several directions through the scroll compressor, to achieve a passage formed of the desired area would be somewhat complex for each particular compressor application and size. The use of the inserts reduces the machining complexity of achieving the exact desired passage area.

The inserts may be inserted along the flow passages leading to the injection ports, or may be inserted into the injection ports themselves. Further, the inserts may be utilized on passages which provide both the economizer function, and also serve as unloader passages leading to an unloader valve. Such combined unloader/economizer passages are disclosed for example in the above-mentioned U.S. Pat. No. 5,996,364.

These and other features of the present invention can be best understood from the following specification and drawings, the following of which is a brief description.

DETAILED DESCRIPTION OF THE PREFERRED EMBODIMENT

Figure 1A:
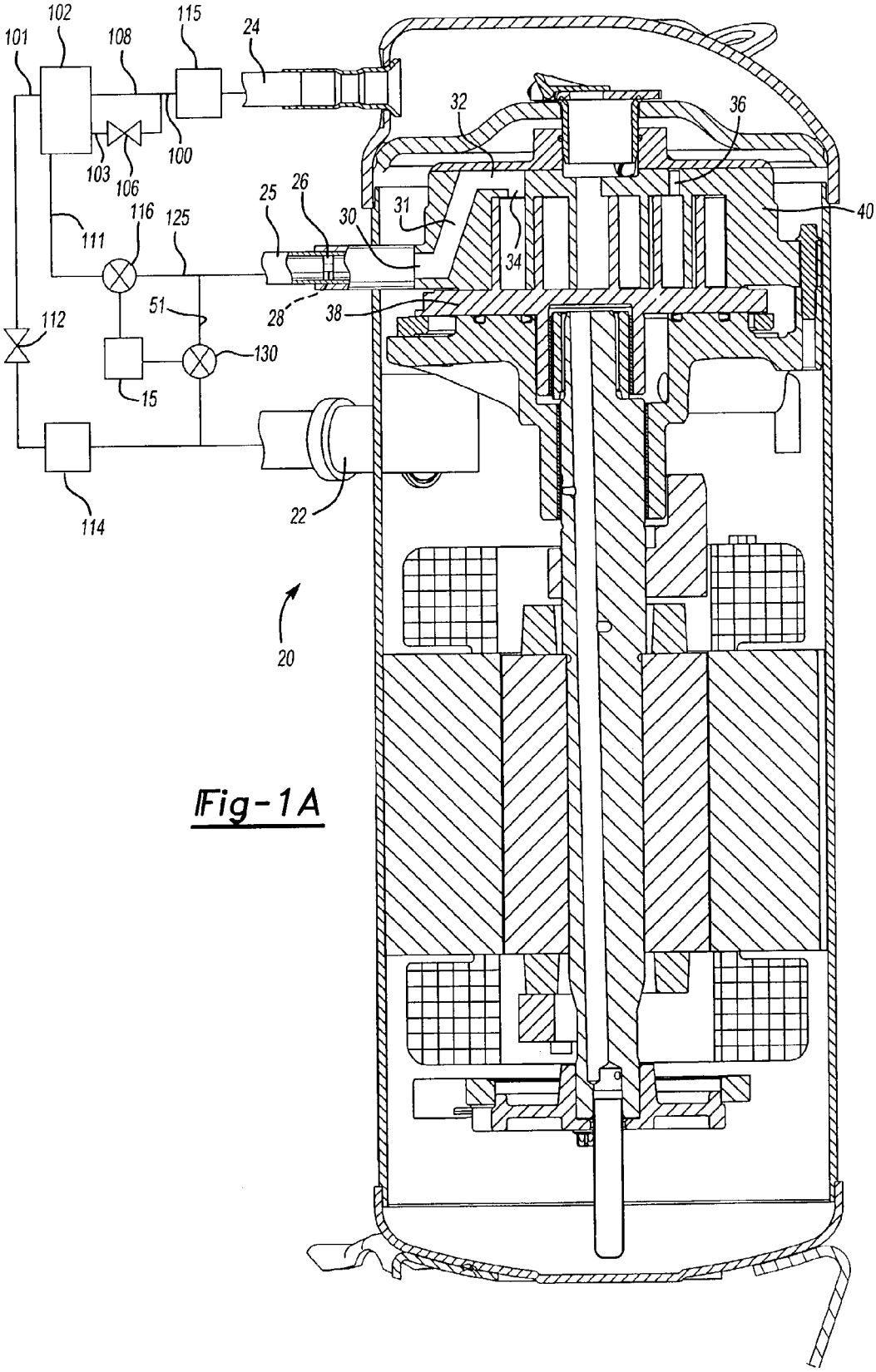
FIG. 1A is a cross-sectional view through a first embodiment of this invention.

FIG. 1A shows a compressor 20 incorporated into a refrigerant cycle. As shown, a suction line 22 leads to a compressor and receives refrigerant from an evaporator 114. A discharge line 24 leads to a condenser 115. A tap 100 taps a portion of the fluid passing from the condenser 115 into a pair of lines leading through an economizer heat exchanger 102. One of the two lines is passed through an expansion valve 106. This causes this tapped refrigerant to reach a lower temperature. Heat is exchanged between the main flow in line 108 and the flow in the tapped line 103. Thus, the main flow leaving the economizer heat exchanger through line 101 is additionally cooled. This main flow passes through the main expansion valve 112, and will have a higher cooling capacity at the evaporator 114.

The refrigerant leaving the economizer heat exchanger from the tapped line 111 passes through an economizer valve 116, and through a line 125. The line 125 splits into two lines 25 and 51. The line 25 leads into compressor economizer passage 30. The line 51 communicates by-pass flow from line 25 or economizer flow from line 125 back to suction. As shown schematically, an unloader valve 130 may selectively communicate by-pass or economizer flow back to suction. As shown, valves 116 and 130 are positioned outside the housing shell. The valve 116 and 130 are controlled to open and close as known by control 15. If the economizer valve 116 is opened and the unloader valve 130 is shut, then economizer fluid is injected back into the compressor. On the other hand, should the unloader valve 130 be opened and the economizer valve 116 is closed, then refrigerant will pass through the line 25 and by-pass line 51 and back to the suction line 22. Typically, only one of valves 116 and 130 is opened at any time. Often they are both closed. Again, this is all as known in the prior art.

Ideally, a larger compressor would normally require a larger port area. Also, a compressor applied in refrigeration would require larger ports than air conditioning applications.

Figure 1B:
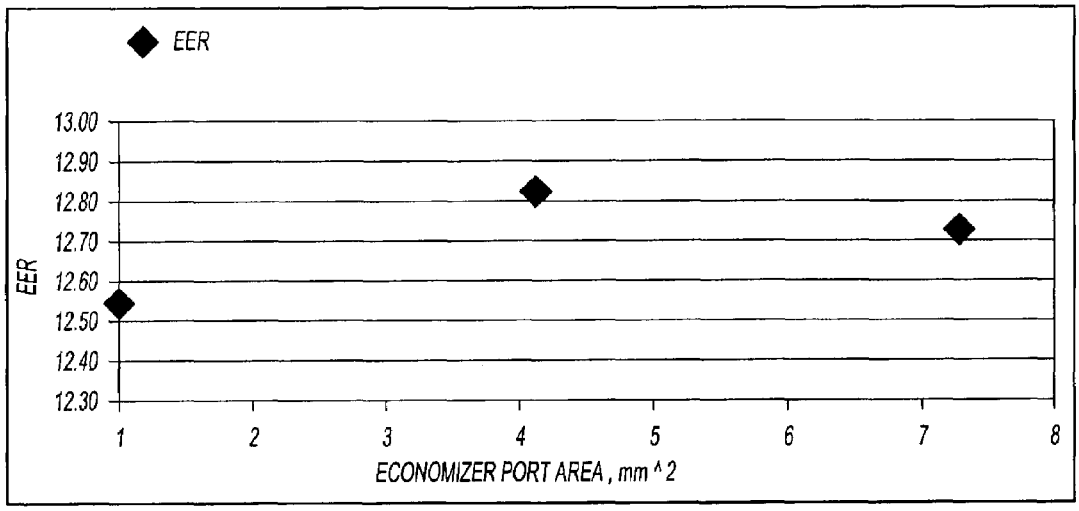
FIG. 1B is a graph showing desired port areas for economizer passages.

FIG. 1B provides an example of how measured cycle energy efficiency rating (EER) varies in relation to the area of opening 28 in insert 26 for an economizer. In this example, $$EER = \frac{\text{system capacity}}{\text{compressor power}},$$

where system capacity is measured in BTU/HR and compressor power is measured in watts. This chart is for a particular compressor size and application. As can be seen from this FIG., the maximum system efficiency is obtained when the area of opening 28 is equal to approximately 4 mm. Other compressor sizes and applications would have different numbers. A worker in this art would understand how to determine this optimum size.

Other factors control a desired by-pass passage size, but a worker in this art would understand how to reach a desired by-pass size.

Figure 2:
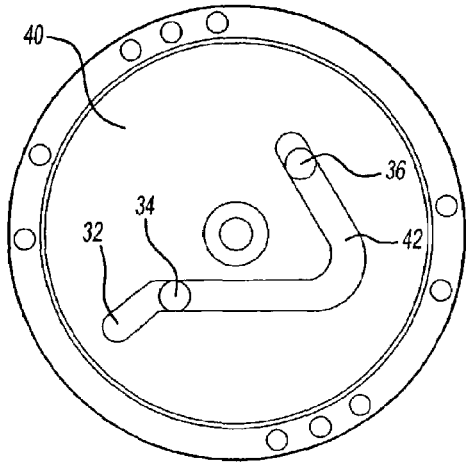
FIG. 2 shows the flow passage of the economizer port through the non-orbiting scroll.

The present invention as shown in FIG. 1A, inserts an insert 26 into the line 25. The insert 26 has an internal opening 28 which is sized to provide the exact desired port area. Line 25 communicates with a crossing passage 30, an upwardly extending passage 31, a crossing passage 32, and eventually into injection ports 34 and 36 in a non-orbiting scroll 40. As is known, an orbiting scroll 38 is positioned adjacent the non-orbiting scroll 40. The structure of the economizer passages within the non-orbiting scroll may be generally as known for example in prior U.S. Pat. No. 6,142,753. As can be appreciated, the passages are somewhat torturous. As an example, and as shown in FIG. 2, the passage 32 communicates directly to the port 34, then through another crossing passage 42 to the other port 36. To form all of these passages or ports of the particular size would be somewhat complex. Moreover, if a compressor manufacturer has a number of desired economizer port areas, it would require complex machining, inventory control, etc. to achieve each of the desired port areas. Thus, the use of the insert 26, which can be selected from a number of available inserts having different size openings 28 allows control of this passage size.

Figure 1C:
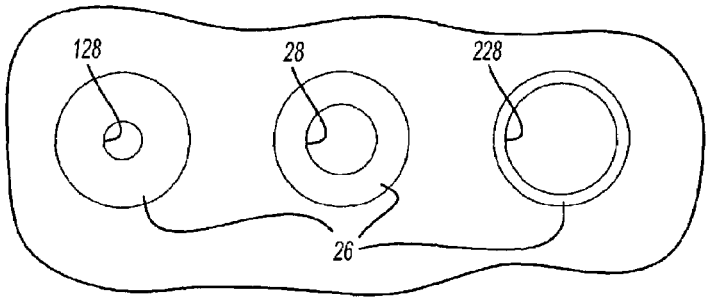
FIG. 1C shows several insert sizes.

Thus, by selecting a particular insert 26 from a variety of sized inserts having different openings 28, 128, 228, etc. as shown in FIG. 1C, the operator or compressor designer can achieve the optimum economizer port area.

Figure 3:
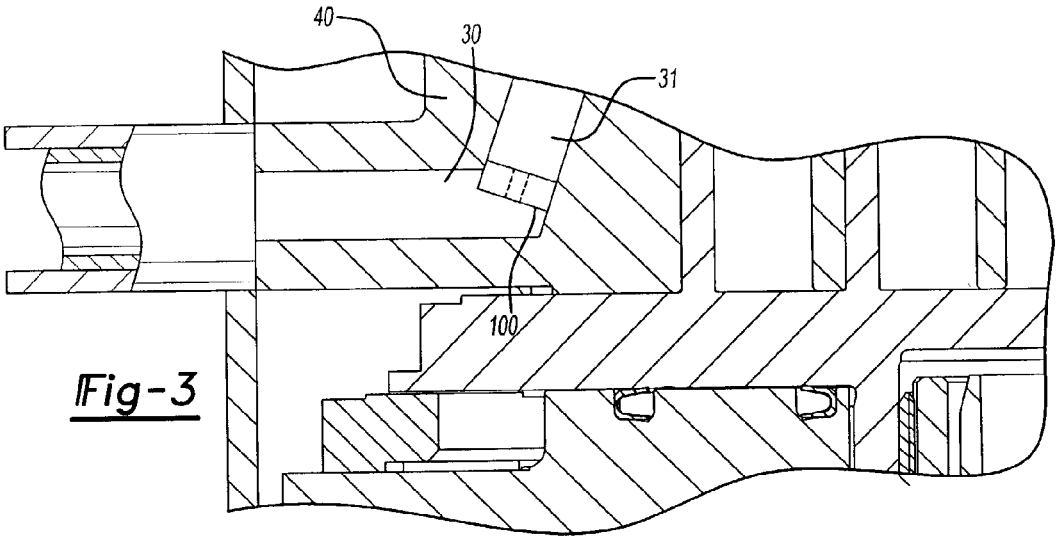
FIG. 3 shows a second embodiment.
Figure 4:
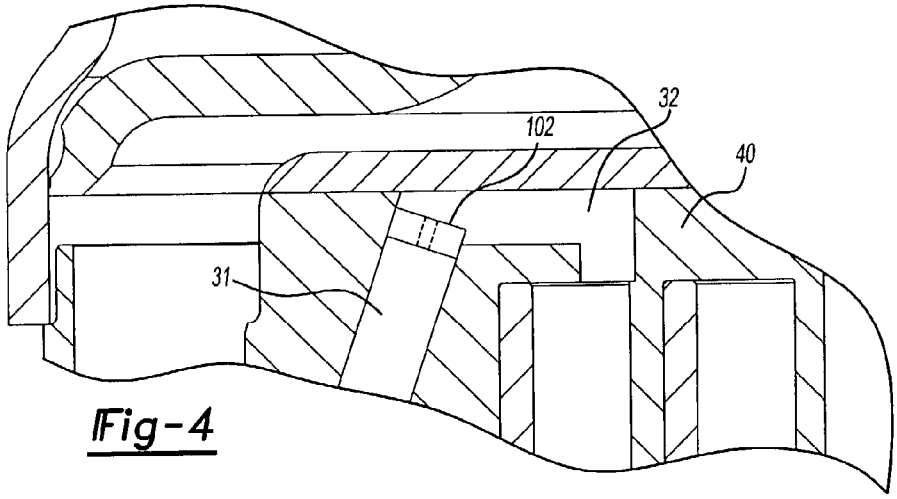
FIG. 4 shows a third embodiment.

As shown in FIG. 3, the insert 100 may also be inserted near one end of the passage 30 where passage 30 transits into passage 31, or as shown in FIG. 4 the insert 102 can be inserted in the passage 32 near location where passage 31 transits into passage 32. The insert could be inserted at any position along the passage 31, although desirably the insert would preferably be at the top end as it would be easier and more accessible to insert the insert at this location.

Figure 5A:
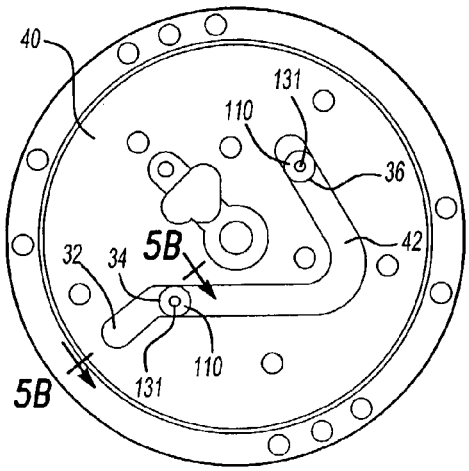
FIG. 5A shows a fourth embodiment.
Figure 5B:
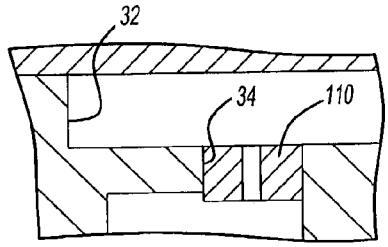
FIG. 5B shows another view of the FIG. 5A embodiment.

FIG. 5A shows another application wherein the inserts 110 are inserted directly into the injection ports 36 and 34. Again, internal openings 131 will control the size of the injection ports in securing the desired optimum economizer port area. FIG. 5B is a cross-section of the FIG. 5A structure.

Any way of securing the insert within the passage may be utilized. As an example, press fitting, an adhesive connection, etc. may be utilized.

The role of the insert is to provide a restriction somewhere along the passage flow to achieve the desired close control over the size of the economizer port area. In this way, a number of small inserts can be provided to allow the compressor designer to have complete control over the economizer port area.

Figure 6:
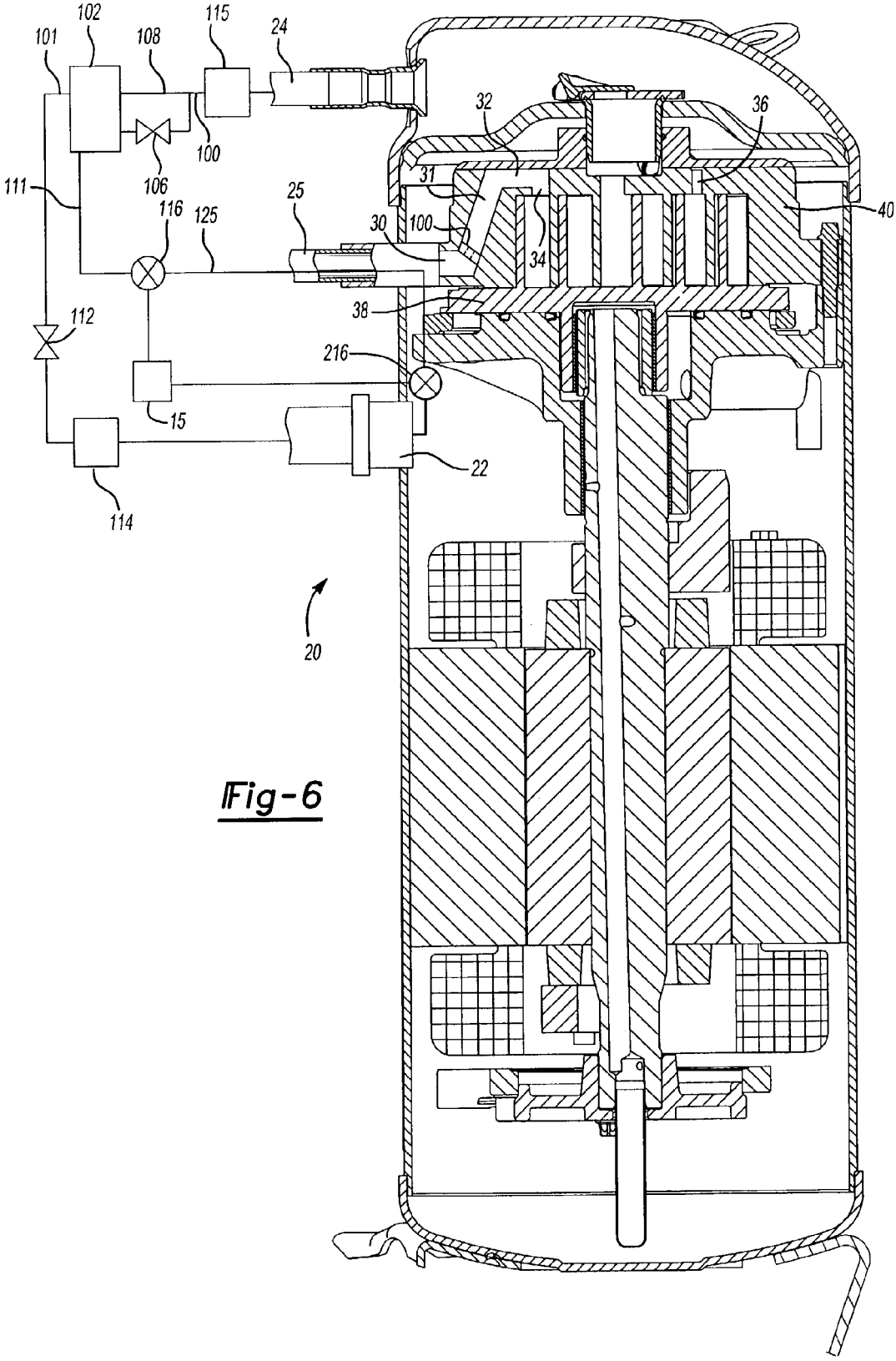
FIG. 6 shows an alternative location.

FIG. 6 schematically shows an embodiment wherein the valve 216 is received within the compressor housing.

Figure 7:
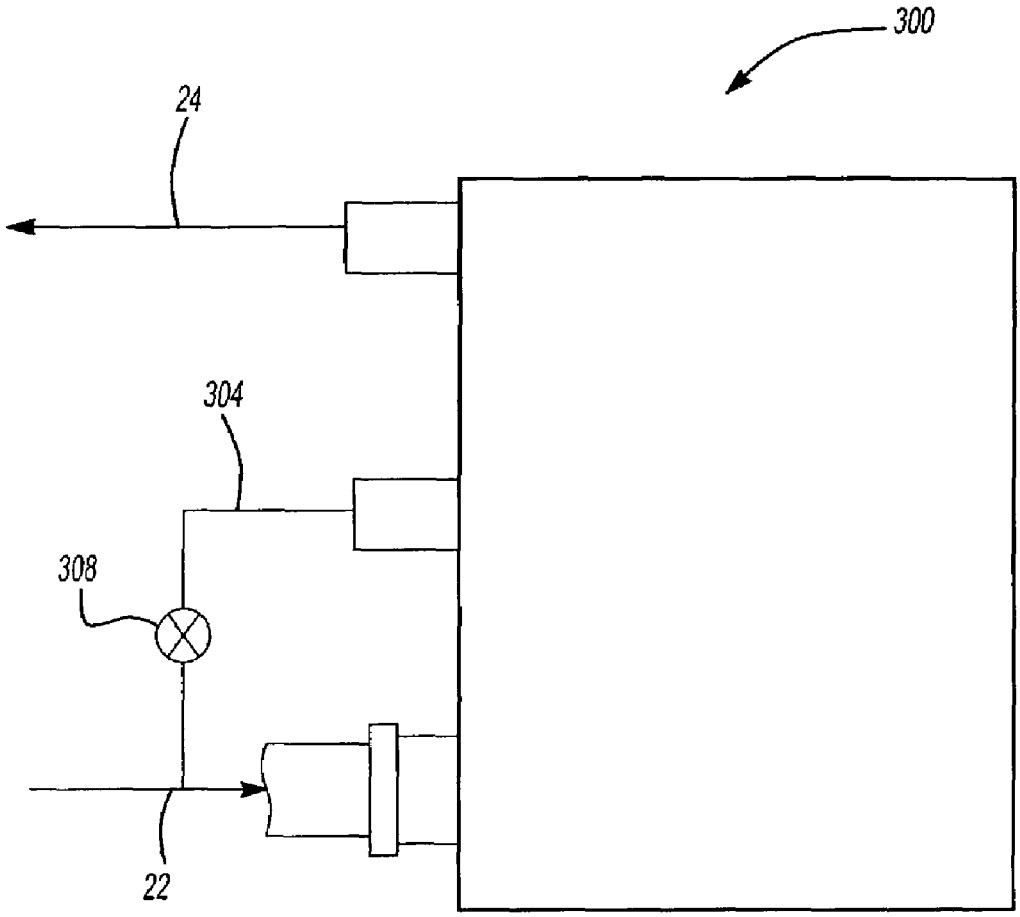
FIG. 7 shows another alternative embodiment.

FIG. 7 shows an embodiment 300 wherein there is no economizer circuit but a by-pass valve 308 communicates with a line 304 to suction 22. Line 304 may communicate with an intermediate pressure location, or may communicate with a discharge pressure location. A discharge line 24 is shown. Here again, the valve 308 may be internal or external to the compressor housing.

Although preferred embodiments of this invention have been shown, a worker of ordinary skill in this art would recognize that certain modifications would come within the scope of this invention. For that reason, the following claims should be studied to determine the true scope and content of this invention.

What is claimed is:

1. A compressor comprising:

a compressor pump unit;

a suction inlet and suction passage communicating to a supply of refrigerant to be compressed by said compressor pump unit;

at least one economizer injection port communicating with said pump unit at a location downstream of said suction inlet;

an economizer passage for supplying refrigerant from outside of said compressor to said economizer injection port, with an insert having an opening, said insert being placed in one of said economizer passage and said economizer injection port, and the size of said opening being selected to achieve a desired economizer port area;

said compressor pump unit is a scroll compressor pump unit;

said economizer passage is formed through a non-orbiting scroll, and said economizer passage receives said refrigerant from a connecting tube, with said insert in said connecting tube; and said economizer passage provides a greater cross-sectional flow area than said insert.

2. A compressor as recited in claim 1, wherein said economizer passage further communicates with an unloader valve, such that said economizer passage provides both unloader and economizer functions.

3. A compressor as recited in claim 2, wherein said unloader valve is positioned outwardly of compressor housing.

4. A compressor as recited in claim 2, wherein said unloader valve is positioned inwardly of compressor housing.

5. A compressor comprising:

a compressor pump unit;

a suction inlet and suction passage communicating to a supply of refrigerant to be compressed by said compressor unit pump;

at least one economizer injection port communicating with said pump unit at a location downstream of said suction inlet;

an economizer passage for supplying refrigerant from outside of said compressor to said economizer injection port, with an insert having an opening, said insert being placed in one of said economizer passage and said economizer injection port, and the size of said opening being selected to achieve a desired economizer port area;

said compressor pump unit is a scroll compressor pump unit;

said economizer passage provides a greater cross-sectional flow area than said insert; and a non-orbiting scroll includes said economizer passage for communicating said refrigerant through said non-orbiting scroll, and to a pair of injection ports in said non-orbiting scroll, said inserts being inserted in said non-orbiting scroll.

6. A compressor as recited in claim 5, wherein said insert is in a common passage delivering refrigerant to each of said ports.

7. A compressor as recited in claim 5, wherein said inserts are inserted into each of said economizer injection ports.

8. A compressor comprising:

a compressor pump unit;

a suction inlet and suction passage communicating to a supply of refrigerant to be compressed by said compressor pump unit;

at least one unloader injection port communicating with said pump unit at a location downstream of said suction inlet;

an unloader passage for supplying refrigerant from said at least one unloader injection port back to said suction inlet, with an insert having a opening, said insert being placed in one of said unloader passage and said at least one unloader injection port, and the size of said opening being selected to achieve a desired unloader port area; and said compressor pump unit is a scroll compressor pump unit, said unloader passage formed through a non-orbiting scroll, with said compressor pump unit communicating a compressed refrigerant into said unloader passage, and with said insert providing a cross-sectional flow passage that is less than a cross-sectionl flow area of said unloader passage.

9. A compressor as recited in claim 8, wherein an unloader valve is positioned outwardly of compressor housing.

10. A compressor as recited in claim 8, wherein an unloader valve is positioned inwardly of compressor housing.

* * * * *

UNITED STATES PATENT AND TRADEMARK OFFICE

CERTIFICATE OF CORRECTION

PATENT NO. : 7,100,386 B2
APPLICATION NO. : 10/390051
DATED : September 5, 2006
INVENTOR(S) : Alexander Lifson It is certified that error appears in the above-identified patent and that said Letters Patent is hereby corrected as shown below:

Claim 5, Column 5, line 21: "unit pump" should be --pump unit--

Claim 5, Column 6, line 1: insert --economizer-- after "of"

Claim 5, Column 6, line 2: "inserts" should be --insert--

Claim 6, Column 6, line 5: insert --economizer injection-- after "said"

Claim 7, Column 6, line 29: "cross-sectionl" should be --cross-sectional--

Signed and Sealed this

Thirteenth Day of March, 2007

JON W. DUDAS
*Director of the United States Patent and Trademark Office*